US011698217B2

(12) United States Patent
Kim et al.

(10) Patent No.: US 11,698,217 B2
(45) Date of Patent: Jul. 11, 2023

(54) REFRIGERATOR

(71) Applicant: LG Electronics Inc., Seoul (KR)

(72) Inventors: Donghwi Kim, Seoul (KR); Sunghee Kang, Seoul (KR); Minho Song, Seoul (KR); Yongbum Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 55 days.

(21) Appl. No.: 17/339,642

(22) Filed: Jun. 4, 2021

(65) Prior Publication Data

US 2021/0293466 A1 Sep. 23, 2021

Related U.S. Application Data

(63) Continuation of application No. 16/249,595, filed on Jan. 16, 2019, now Pat. No. 11,047,608.

(30) Foreign Application Priority Data

Apr. 20, 2018 (KR) ..... 10-2018-0046204

(51) Int. Cl.
*F25D 17/06* (2006.01)
*F25D 11/02* (2006.01)

(52) U.S. Cl.
CPC ..... *F25D 17/065* (2013.01); *F25D 11/02* (2013.01)

(58) Field of Classification Search
CPC ..... F25D 17/065; F25D 17/062; F25D 17/06; F25D 11/02; F25D 2317/062;
(Continued)

(56) References Cited

U.S. PATENT DOCUMENTS 4,058,989 A * 11/1977 Horvay ..... F25D 11/02 454/193
5,875,642 A * 3/1999 Lee ..... F25D 17/062 62/256

(Continued)

FOREIGN PATENT DOCUMENTS

CN 203286836 11/2013
CN 107120905 9/2017

(Continued)

OTHER PUBLICATIONS

Partial European Search Report in European Appln. No. 21181311.8, dated Oct. 25, 2021, 16 pages.

(Continued)

*Primary Examiner* — Emmanuel E Duke
(74) *Attorney, Agent, or Firm* — Fish & Richardson P.C.

(57) ABSTRACT

Provided is a refrigerator. The refrigerator includes a cabinet including an inner case defining a storage compartment, an outer case surrounding the outside of the inner case, and an insulation material provided between the inner case and the outer case, a storage compartment door opening and closing the storage compartment, a cold air duct provided in the storage compartment and disposed in an upper side of the storage compartment to discharge cold air to the storage compartment, and a guide duct disposed outside the inner case to communicate with the cold air duct and extending to the storage compartment door to guide the cold air received from the cold air duct to the storage compartment door.

21 Claims, 18 Drawing Sheets

(58) Field of Classification Search
CPC ..... F25D 2317/0665; F25D 2317/0671; F25D 2317/063; F25D 2317/066; F25D 2317/067; F25D 23/066
See application file for complete search history.

(56) References Cited

U.S. PATENT DOCUMENTS

| | | | | |
|---|---|---|---|---|
| 5,979,174 | A | 11/1999 | Kim et al. | |
| 6,044,654 | A | 4/2000 | Igari et al. | |
| 2002/0023454 | A1* | 2/2002 | Watanabe | F25D 11/022 62/285 |
| 2002/0033028 | A1 | 3/2002 | Lee et al. | |
| 2008/0156024 | A1* | 7/2008 | Shin | F25C 5/182 62/344 |
| 2009/0173098 | A1* | 7/2009 | Kim | F25D 17/065 62/344 |
| 2014/0373567 | A1 | 12/2014 | Otsuki et al. | |
| 2017/0108264 | A1 | 4/2017 | Luo | |
| 2018/0172336 | A1* | 6/2018 | Bae | F25D 17/062 |
| 2018/0187945 | A1 | 7/2018 | Jung | |

FOREIGN PATENT DOCUMENTS

| | | | | |
|---|---|---|---|---|
| CN | 107120905 | A * | 9/2017 | F25D 17/08 |
| JP | H03221774 | | 9/1991 | |
| JP | H11051537 | | 2/1999 | |
| JP | 2004069136 | | 3/2004 | |
| KR | 19970022182 | | 5/1997 | |
| KR | 20020014094 | | 2/2002 | |
| KR | 1020030063708 | | 7/2003 | |
| KR | 100614317 | | 8/2006 | |
| KR | 20070096377 | | 10/2007 | |
| KR | 101048222 | | 7/2011 | |
| WO | WO2006067735 | | 6/2006 | |

OTHER PUBLICATIONS

Office Action in Korean Appln. No. 10-2018-0046204, dated Sep. 16, 2021, 11 pages.

Korean Notice of Allowance in Korean Appln. No. 10-2018-0046204, dated Nov. 26, 2021, 4 pages (with English translation).

EP Extended European Search Report in European Appln. No. 18192842.5, dated Mar. 25, 2019, 9 pages.

EP Office Action in European Appln. No. 18192842.5, dated Aug. 27, 2020, 6 pages.

* cited by examiner

REFRIGERATOR

CROSS-REFERENCE TO RELATED APPLICATIONS

The present application is a continuation of U.S. application Ser. No. 16/249,595, filed on Jan. 16, 2019, which claims priority under 35 U.S.C. 119 and 35 U.S.C. 365 to Korean Patent Application No. 10-2018-0046204, filed on Apr. 20, 2018. The disclosures of the prior applications are incorporated by reference in their entirety.

BACKGROUND

Embodiments provide a refrigerator.

Refrigerators are home appliances that store foods at a low temperature. It is essential that a storage compartment is always maintained at a constant low temperature. At present, in the case of household refrigerators, the storage compartment is maintained at a temperature within the upper and lower limit ranges on the basis of a set temperature. That is, the refrigerator is controlled through a method in which when the storage compartment increases to the upper limit temperature, a refrigeration cycle operates to cool the storage compartment, and when the storage compartment reaches the lower limit temperature, the refrigeration cycle is stopped.

A constant temperature control method for maintaining a storage compartment of a refrigerator at a certain temperature is disclosed in Korean Patent Publication No. 1997-0022182 (published on May 28, 1997).

According to the prior art document, when a storage compartment temperature is higher than a set temperature, a compressor and a fan are driven, and simultaneously, the storage compartment damper is fully opened. When the storage compartment temperature is cooled to the set temperature, the driving of the compressor and/or the fan is stopped, and simultaneously, the storage compartment damper is closed.

In the case of such a prior art document, since a process of stopping an operation of the compressor is repeated when the storage compartment temperature is cooled to the set temperature or less after the storage compartment temperature of the refrigerator increases to the set temperature or more, and the compressor is driven, power consumption increases when the compressor is driven again.

Also, in the case of the prior art document, when a damper is fully opened to cool the storage compartment, there is high possibility that cool air is excessively supplied to the storage compartment in a state in which the damper is completely opened so that the storage compartment is overcooled. That is, it may be difficult to maintain the constant temperature state of the storage compartment.

SUMMARY

Embodiments provide a refrigerator in which a temperature deviation within a storage compartment is minimized.

Embodiments also provide a refrigerator in which reduction of capacity within a storage compartment is prevented by a guide duct that guides cold air to a storage compartment door.

Embodiments also provide a refrigerator in which cold air of a cold air duct disposed in a storage compartment smoothly flows to a guide duct disposed outside the storage compartment.

Embodiments also provide a refrigerator in which deformation of a guide duct disposed between an inner case and an outer case is prevented while an insulation material is formed.

In one embodiment, a refrigerator includes: a cabinet including an inner case defining a storage compartment, an outer case surrounding the outside of the inner case, and an insulation material provided between the inner case and the outer case; a storage compartment door opening and closing the storage compartment; a cold air duct provided in the storage compartment and disposed in an upper side of the storage compartment to discharge cold air to the storage compartment; and a guide duct disposed outside the inner case to communicate with the cold air duct and extending to the storage compartment door to guide the cold air received from the cold air duct to the storage compartment door.

The details of one or more embodiments are set forth in the accompanying drawings and the description below. Other features will be apparent from the description and drawings, and from the claims.

DETAILED DESCRIPTION

Figure 1:
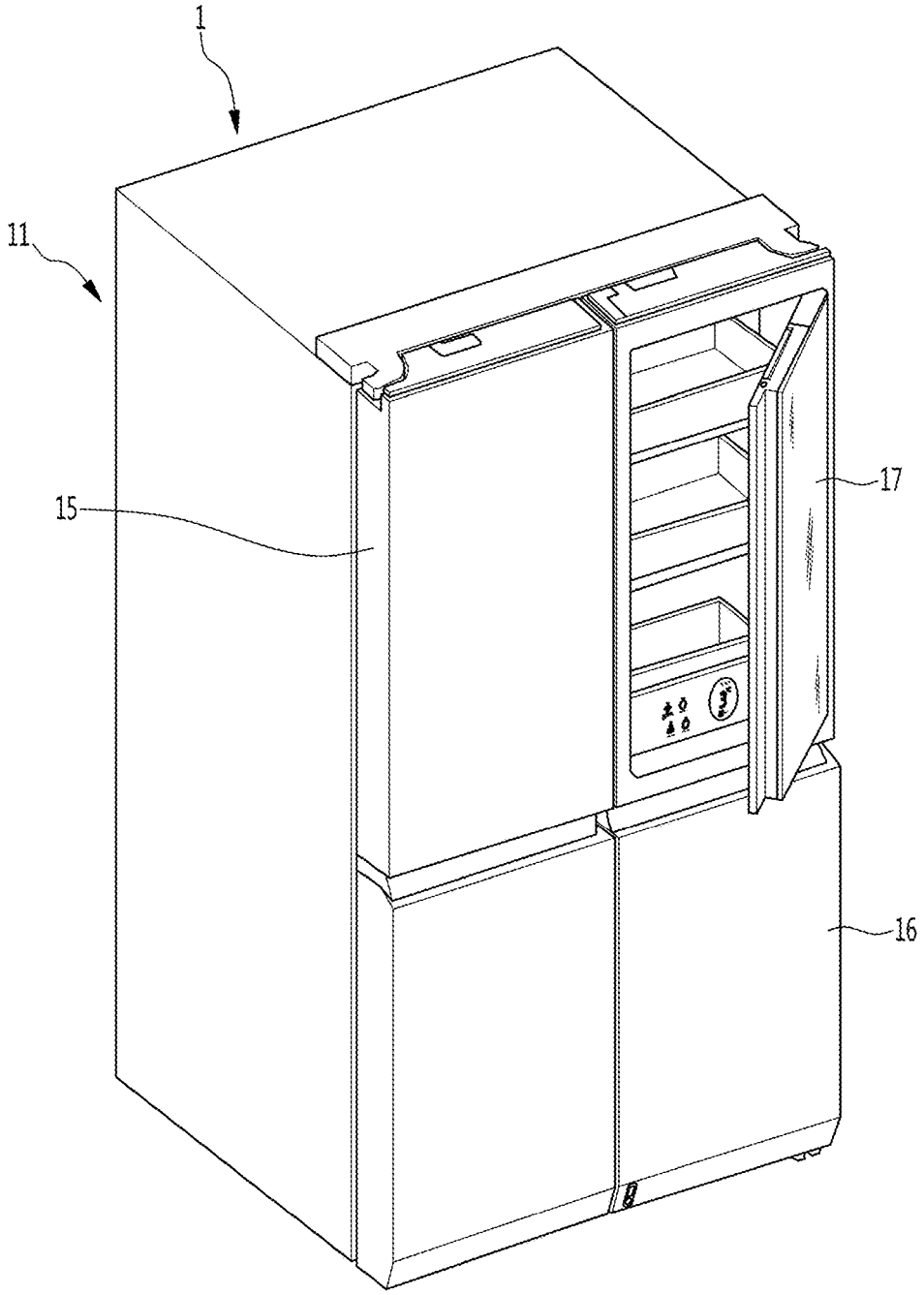
FIG. 1 is a perspective view of a refrigerator according to an embodiment.
Figure 2:
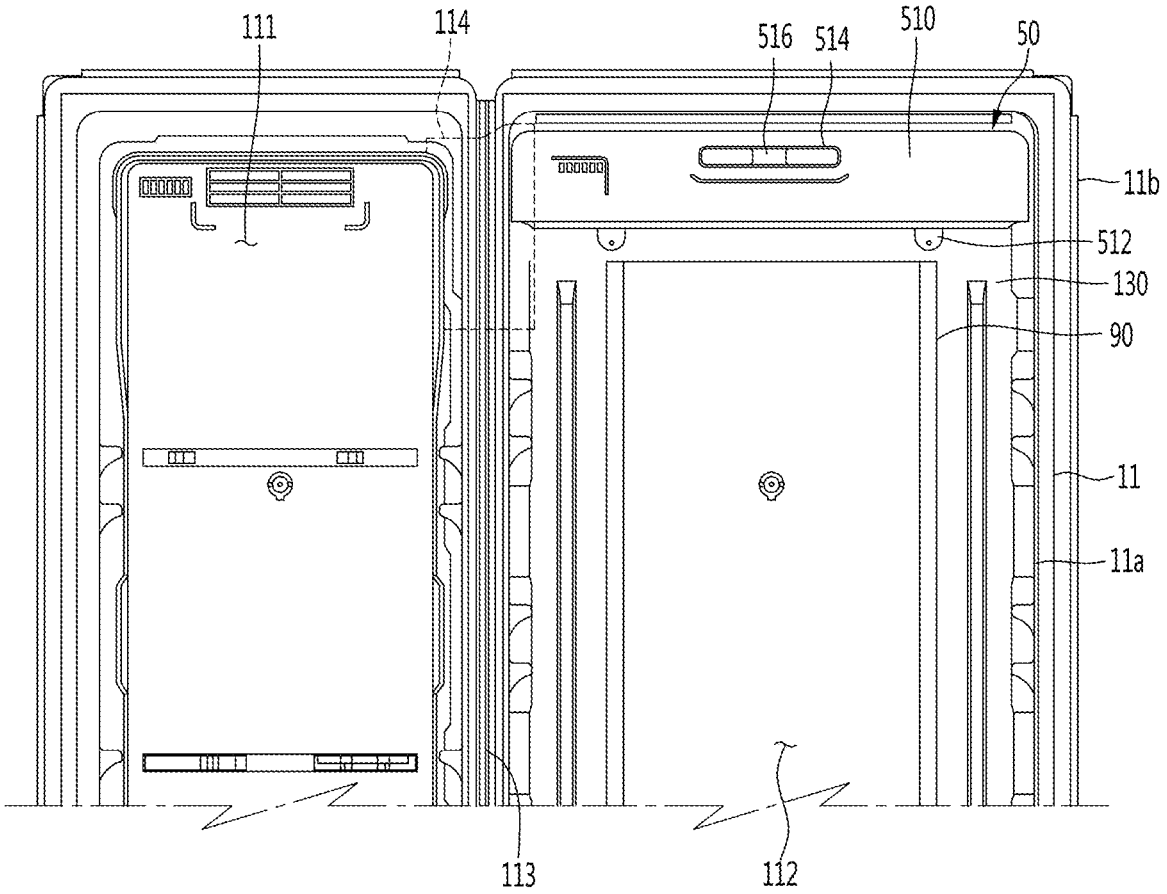
FIG. 2 is a view illustrating the inside of a cabinet according to an embodiment.
Figure 3:
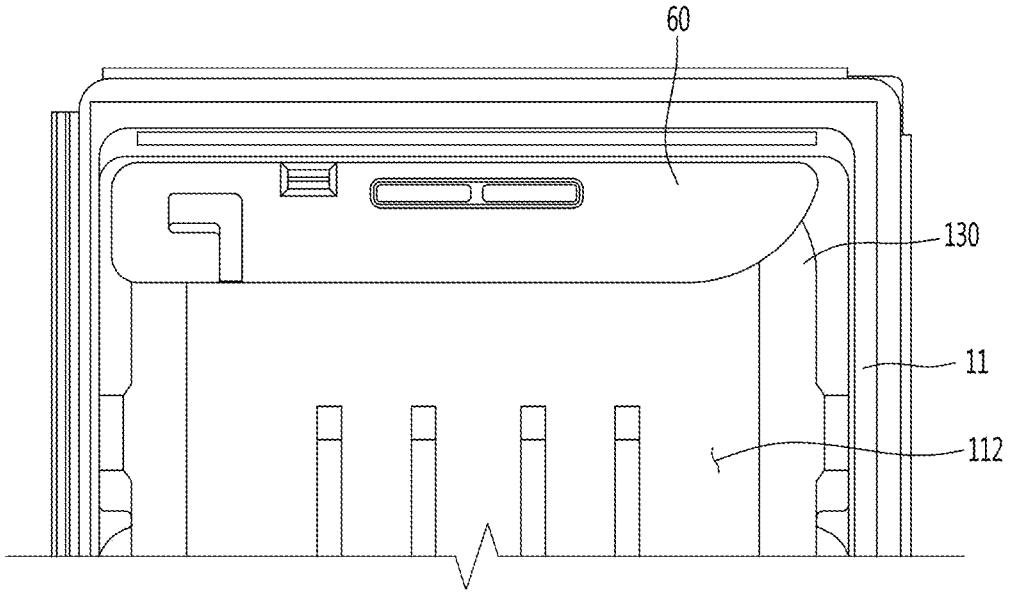
FIG. 3 is a view of a cold air duct disposed in a refrigerating compartment according to an embodiment.
Figure 4:
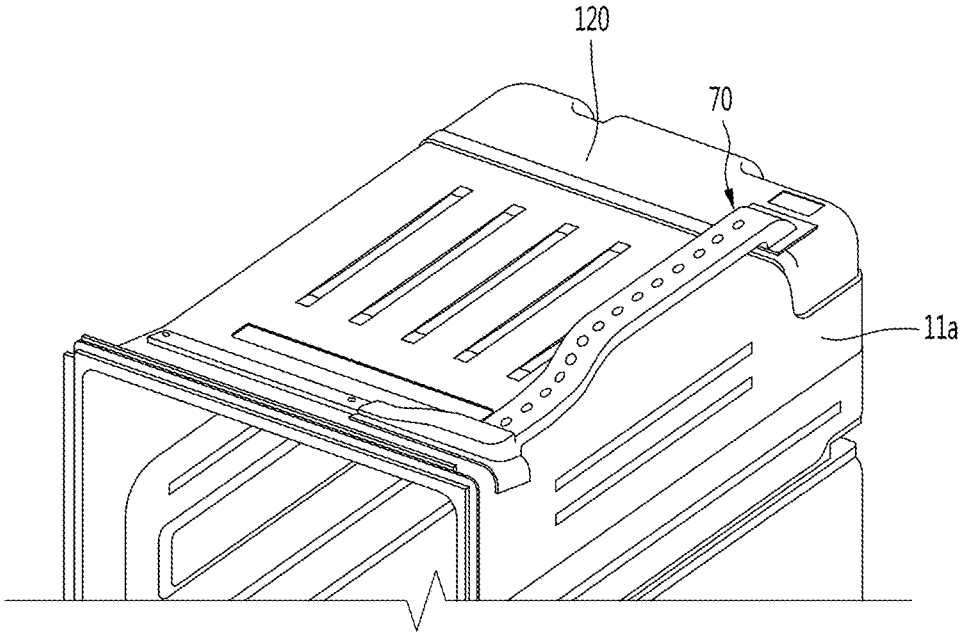
FIG. 4 is a view of a guide duct disposed outside an inner case according to an embodiment.

FIG. 1 is a perspective view of a refrigerator according to an embodiment, FIG. 2 is a view illustrating the inside of a cabinet according to an embodiment, FIG. 3 is a view of a cold air duct disposed in a refrigerating compartment according to an embodiment, and FIG. 4 is a view of a guide duct disposed outside an inner case according to an embodiment.

Referring to FIGS. 1 to 4, a refrigerator 1 according to an embodiment may include a cabinet 11 defining a storage compartment and a storage compartment door that opens and closes the storage compartment of the cabinet 11.

The cabinet 11 includes an inner case 11*a* and an outer case 11*b*. An insulation material may be disposed between the inner case 11*a* and the outer case 11*b*.

The storage compartment may include a freezing compartment 111 and a refrigerating compartment 112. The freezing compartment 111 and the refrigerating compartment 112 may store articles such as foods.

The inner case 11*a* may define the freezing compartment 111 and the freezing compartment 112.

The freezing compartment 111 and the refrigerating compartment 112 may be horizontally or vertically partitioned within the cabinet 11 by a partition wall 113.

FIG. 2 illustrates a structure in which the freezing compartment 111 and the refrigerating compartment 112 are horizontally partitioned by the partition wall 113.

The storage compartment door may include a freezing compartment door 15 for opening and closing the freezing compartment 111 and a refrigerating compartment door 16 for opening and closing the refrigerating compartment 112.

Although not limited, the refrigerating compartment door 16 may further include a sub door 17 for withdrawing the articles stored in the refrigerating compartment door 16 without opening the refrigerating compartment door 16.

Also, a connection passage 114 providing a cold air path for supplying cold air into the refrigerating compartment 112 is provided in the partition wall 113.

The refrigerator 1 may further include a cold air duct 60 receiving the cold air from the connection passage 114. The cold air duct 60 may be disposed in the refrigerating compartment 112 that is an inner space of the inner case 11*a*.

For example, the cold air duct 60 may be disposed close to a rear wall 130 of the inner case 11*a* in the refrigerating compartment 112. Also, the cold air duct 60 may be disposed in an upper portion of the refrigerating compartment 112.

Although not limited, the cold air duct 60 may contact an upper wall 120 of the inner case 11*a* in the refrigerating compartment 112.

The cold air duct 60 may discharge the cold air flowing through the connection passage 114 to the refrigerating compartment 112.

A damper (not shown) controlling a flow of the cold air may be provided in at least one of the connection passage 114 and the cold air duct 60. The damper may be driven by a damper driving part (not shown).

An amount of cold air introduced from the connection passage 114 into the cold air duct 60 may be adjusted according to an angle of opening of the damper.

The refrigerator 1 may further include a discharge duct 90 communicating with the cold air duct 60 to discharge the cold air to the refrigerating compartment 112.

The discharge duct 90 may be disposed below the cold air duct 60 to communicate with the cold air duct 60. The discharge duct 90 may include a plurality of discharge ports that are vertically spaced apart from each other to uniformly discharge the cold air to the refrigerating compartment 112 in vertical and horizontal directions.

For example, the discharge duct 90 may be installed in the rear wall 130 of the inner case 11*a*.

The refrigerator 1 may further include a guide duct 70 communicating with the cold air duct 60 to guide a portion of the cold air supplied to the cold air duct 60 to the refrigerating compartment door 16.

Although not limited, the guide duct 70 may be disposed outside the inner case 11*a*. That is, the guide duct 70 may be disposed outside the refrigerating compartment 112. For example, the guide duct 70 may be installed in the upper wall 120 of the inner case 11*a*.

The guide duct 70 may extend forward and backward from an upper side of the inner case 11*a* to guide the cold air supplied from the cold air duct 60 to an upper side of the refrigerating compartment door 16.

The refrigerator 1 may further include a duct cover 50 covering the cold air duct 60 within the refrigerating compartment 112.

The duct cover 50 may cover at least front surface and bottom surface of the cold air duct 60.

Thus, the duct cover 50 may include at least front surface and bottom surface. The bottom surface may be bent from the front surface to extend.

The duct cover 50 may be installed, for example, on the rear wall 130 of the inner case 11*a* in the state of covering the cold air duct 60. An installation part 512 to be installed on the rear wall 130 of the inner case 11*a* may be disposed on the bottom surface of the duct cover 50. Although not limited, the installation part 512 may be coupled to the rear wall 130 by a coupling member such as a screw.

The duct cover 50 may have substantially the same horizontal width as that of the refrigerating compartment 112. The duct cover 50 may have a longitudinal width greater than that of the cold air duct 60.

The duct cover 50 may include a cold air opening 514 so that the cold air passes therethrough in the state of covering the cold air duct 60.

For example, the cold air opening 514 may be defined in the front surface of the duct cover 50.

Although described below, a plurality of front outlets may be provided in the cold air duct, and a partition part 516 for partitioning the cold air opening 514 into a plurality of openings may be provided in the duct cover 50 to correspond to the plurality of front outlets.

The refrigerator 1 may further include a refrigeration cycle for cooling the freezing compartment 111 and/or the refrigerating compartment 112.

In detail, the refrigeration cycle includes a compressor compressing a refrigerant to generate a high-temperature high-pressure gas refrigerant, a condenser condensing the refrigerant passing through the compressor to generate a high-temperature high-pressure liquid refrigerant, an expansion member expanding the refrigerant passing through the condenser, and an evaporator evaporating the refrigerant passing through the expansion member. Also, the evaporator may include an evaporator for the freezing compartment.

Hereinafter, the cold air duct 60 will be described in detail.

Figure 5:
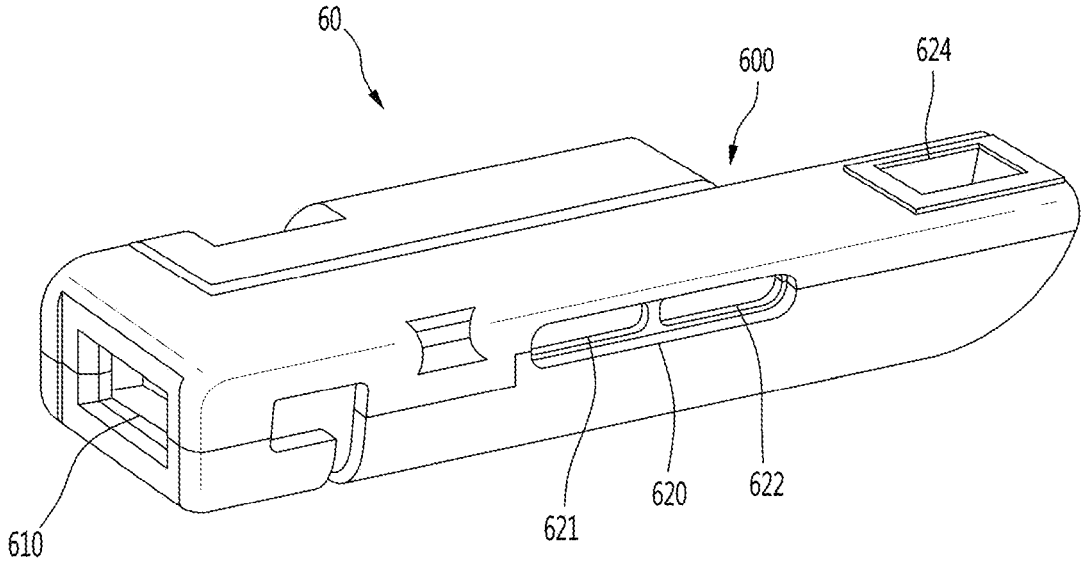
FIGS. 5 and 6 are perspective views of the cold air duct according to an embodiment.
Figure 6:
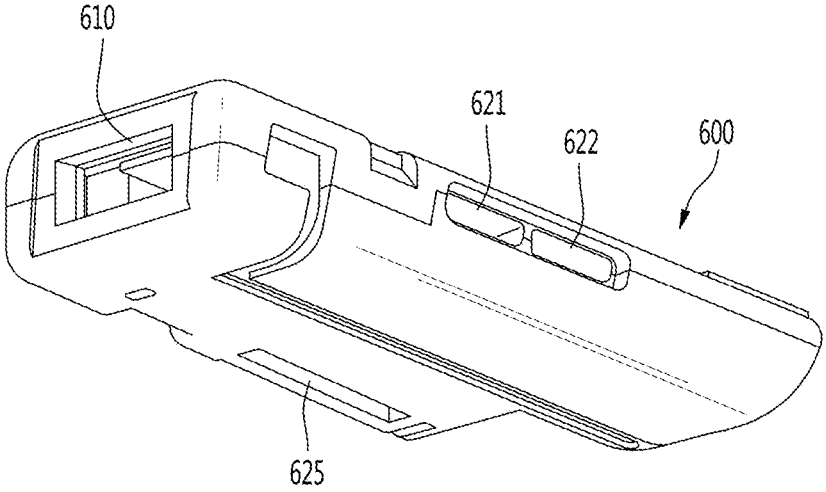
Figure 7:
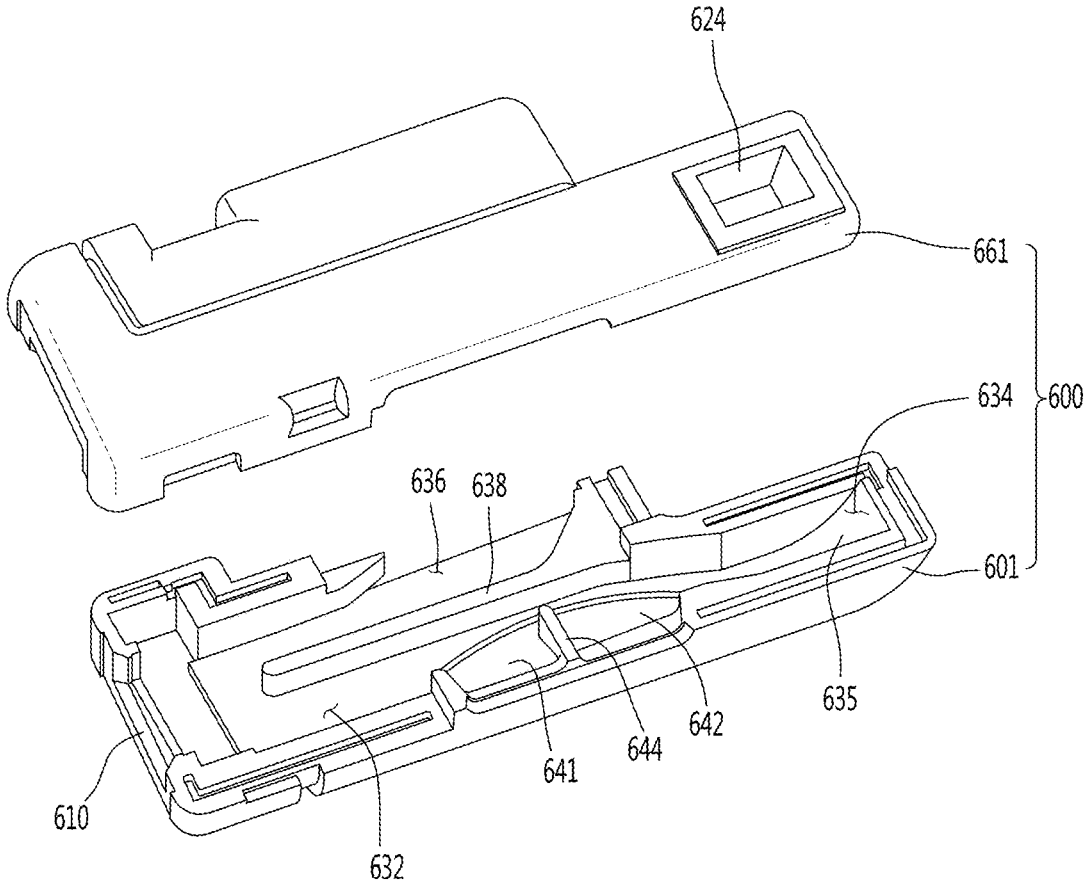
FIG. 7 is an exploded perspective view of the cold air duct according to an embodiment.
Figure 8:
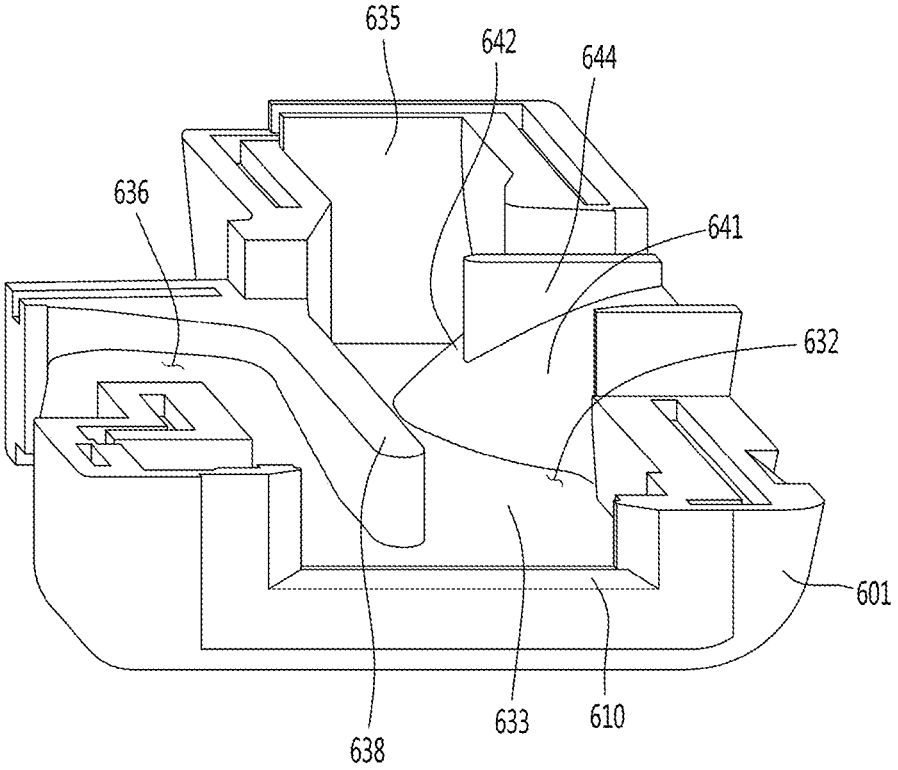
FIG. 8 is a perspective view of a lower frame according to an embodiment.
Figure 9:
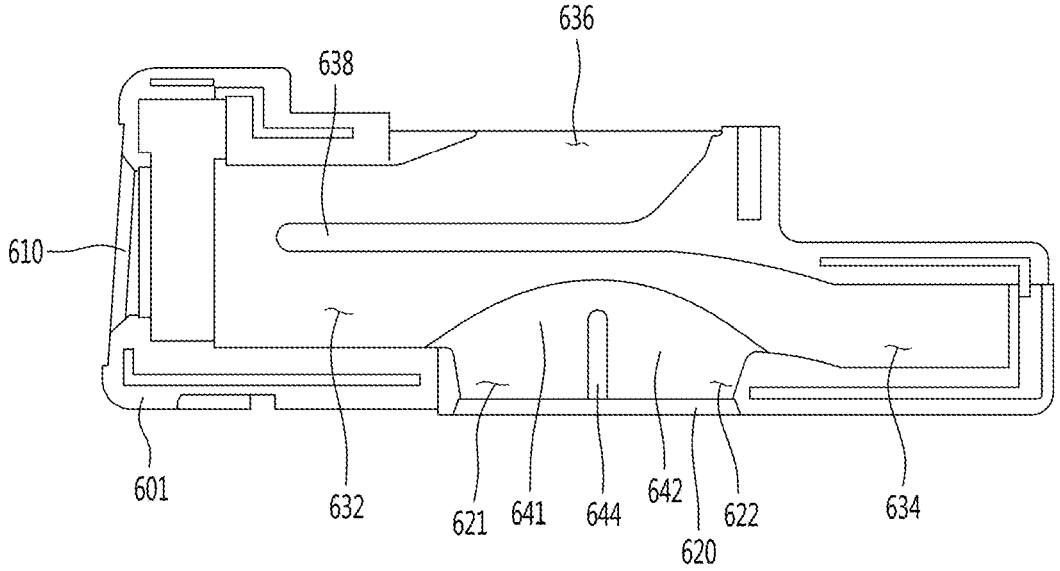
FIG. 9 is a plan view of the lower frame of FIG. 8.

FIGS. 5 and 6 are perspective views of the cold air duct according to an embodiment, FIG. 7 is an exploded perspective view of the cold air duct according to an embodiment, FIG. 8 is a perspective view of a lower frame according to an embodiment, and FIG. 9 is a plan view of the lower frame of FIG. 8.

Referring to FIGS. 5 and 9, the cold air duct 60 may include a frame 600 defining an outer appearance thereof. Although not limited, the frame 600 may have a substantially rectangular parallelepiped shape.

The frame 600 may include a lower frame 601 and an upper frame 661 coupled to the lower frame 601.

The cold air duct 60 may include a cold air inlet 610 through which the cold air is introduced. The cold air inlet 610 may be provided in one surface of the frame 600. The cold air inlet 610 communicates with the connection passage 114. Thus, the cold air inlet 610 may be provided, for example, in a left surface (or a first surface of both surfaces) of the frame 600.

One of the lower frame 601 and the upper frame 661 may provide the cold air inlet 610, or each of the lower frame 601 and the upper frame 661 may provide the cold air inlet 610.

The cold air duct 60 may further include a plurality of cold air outlets for discharging the cold air introduced through the cold air inlet 610.

The plurality of cold air outlets may include a first cold air outlet 620 for directly discharging the cold air into the refrigerating compartment 112, a second cold air outlet 624 for discharging the cold air into the guide duct 70, and a third cold air outlet 625 for discharging the cold air into the discharge duct 90.

Although not limited, the first to third cold air outlets 620, 624, and 625 may be provided in different surfaces of the cold air duct 60.

For example, the first cold air outlet 620 may be provided in a front surface (a surface facing the refrigerating compartment door 16) of the frame 600, and the second cold air outlet 624 may be provided in a top surface of the frame 600. Also, the third cold air outlet 625 may be provided in a bottom surface of the frame 600.

For example, the second cold air outlet 624 may be provided in the upper frame 661, and the third cold air outlet 625 may be provided in the lower frame 601.

The frame 600 may further include a first cold air passage 632 connecting the cold air inlet 610 to the first cold air outlet 620.

The first cold air outlet 620 may be partitioned by a partition rib 644 and thus be divided into a first front outlet 621 and a second front outlet 642.

Although not limited, the first cold air outlet 620 may be disposed at a central portion of the front surface of the frame 600.

The first cold air outlet 620 may be disposed in the front surface of the frame 600. Here, the first cold air outlet 620 may be disposed at a predetermined height. The cold air inlet may be disposed in a side surface of the frame 600.

The cold air introduced into the cold air duct through the cold air inlet 610 has to smoothly flow to the first cold air outlet 620. Thus, in this embodiment, guide parts 641 and 642 guiding the cold air of the first cold air passage 632 so that the cold air smoothly flows to the first cold air outlet 620 may be provided in the bottom of the first cold air passage 632.

For example, the guide parts 641 and 642 may be provided on the lower frame 601.

The guide parts 641 and 642 may protrude from the bottom of the first cold air passage 632 to extend to be rounded upward to the first cold air outlet 620.

Also, the partition rib 644 may protrude upward from the guide parts 641 and 642 to extend to the first cold air outlet 620. The partition rib 644 may approximately bisect the first cold air outlet 620. Alternatively, an additional partition rib may be disposed on the upper frame 661 at a position corresponding to the partition rib 644.

The first front outlet 621 and the second front outlet 622 may be horizontally arranged, and the first outlet 621 may be disposed closer to the cold air inlet 610 when compared to the second front outlet 622.

In this embodiment, when the guide parts 641 and 642 are provided, the cold air introduced through the cold air inlet 610 may be changed in flow direction by the guide parts 641 and 642 to flow to the first cold air outlet 620.

On the other hand, since the first front outlet 621 is closer to the cold air inlet 610 when compared to the second front outlet 622, if the partition rib 644 is not provided, an amount of cold air discharged to the second front outlet 622 may relatively increase by an inertial flow of the cold air when compared to that of cold air discharged to the first front outlet 621.

However, according to this embodiment, since the partition rib 644 extends from the guide parts 641 and 642 to the first cold air outlet 620, concentration of the cold air of the first cold air passage 632 into the second front outlet 622 may be prevented.

That is, the partition rib 644 may act as flow resistance within the first cold passage 632 to reduce an amount of cold air flowing to the second front outlet 622.

Thus, the cold air of the first cold air passage 632 may flow to be divided into the first front outlet 621 and the second front outlet 622 by the partition rib 644.

The cold air discharged from the first cold air outlet 620 may flow downward. In this case, the cold air discharged from the first cold air outlet 620 may not flow to the upper side of the refrigerating compartment door 16.

However, in the case of this embodiment, since the guide parts 641 and 642 are rounded upward to extend to the first cold air outlet 620, the cold air of the first cold air passage 632 may flow upward toward the first cold air outlet 620 to reduce a downward flow of the cold air in the first cold air outlet 620.

The partition rib 644 may be disposed at a position at which the guide parts 641 and 642 are approximately bisected. Thus, the guide parts 641 and 642 may be divided into a first guide part 641 and a second guide part 642 by the partition rib 644.

The first guide part 641 and the second guide part 642 may be approximately symmetrical to each other with respect to the partition rib 644.

The frame 600 may provide the first cold air passage 632 and further include a third cold air passage 636 and a passage partition part 638 partitioning the first cold air passage 632, which will be described later.

The passage partition part 638 may be provided in each of the lower frame 601 and the upper frame 661 or provided in one of the lower frame 601 and the upper frame 661.

The passage partition part 638 may horizontally extend from the frame 600 and have one end spaced apart from the cold air inlet 610.

Thus, the first cold air passage 632 and the third cold air passage 636 may be arranged in a front and rear direction in the frame 600 by the passage partition part 638.

Thus, a portion of the cold air introduced through the cold air inlet 610 may flow to the first cold air passage 632, and the other portion may flow to the third cold air passage 636.

The partition rib 644 may be spaced apart from the passage partition part 638 so that the cold air of the first cold air passage 632 flows to the second front outlet 622.

The frame 600 may further include a second cold air passage 634 guiding a portion of the cold air of the first cold air passage 632 to the second cold air outlet 624.

The second cold air passage 634 may extend from the first cold air passage 632 to communicate with the second cold air outlet 624.

For example, the first cold air passage 632 may be disposed between the cold air inlet 610 and the second cold air passage 634. Thus, a portion of the cold air introduced through the cold air inlet 610 may pass through the first cold air passage 632 to flow to the second cold air passage 634.

The guide parts 641 and 642 may be spaced apart from the passage partition part 638 so that the cold air of the first cold air passage 632 smoothly flows to the second cold air passage 634.

Thus, a portion of the cold air introduced through the cold air inlet 610 may substantially flow to the first cold air passage 632 to flow to the second cold air passage 634.

For another example, the cold air introduced through the cold air inlet 610 may flow to the second cold air passage 634 by the additional passage partition part without passing through the first cold air passage 632.

The cold air flowing to the second cold air passage 634 may flow to the second cold air outlet 624 provided in the top surface of the frame 600.

The second cold air outlet 624 may be provided in the top surface of the frame 600. For example, the second cold air outlet 624 may be disposed close to a right surface (a second face opposite to the first surface of both the surfaces).

The frame 600 may include a rounded guide surface 635 so that the cold air of the second cold air passage 634 smoothly flows to the second cold air outlet 624.

The cold air of the second cold air passage 634 may be changed from a horizontal flow to a vertical flow by the guide surface 635 to pass through the second cold air outlet 624.

As described above, the frame 600 may further include a third cold air passage 636 guiding the cold air of the cold air inlet 610 to the third cold air outlet 625.

The third cold air outlet 625 may be provided in the bottom surface of the frame 600 at a position that is close to the rear surface of the frame 600.

Figure 10:
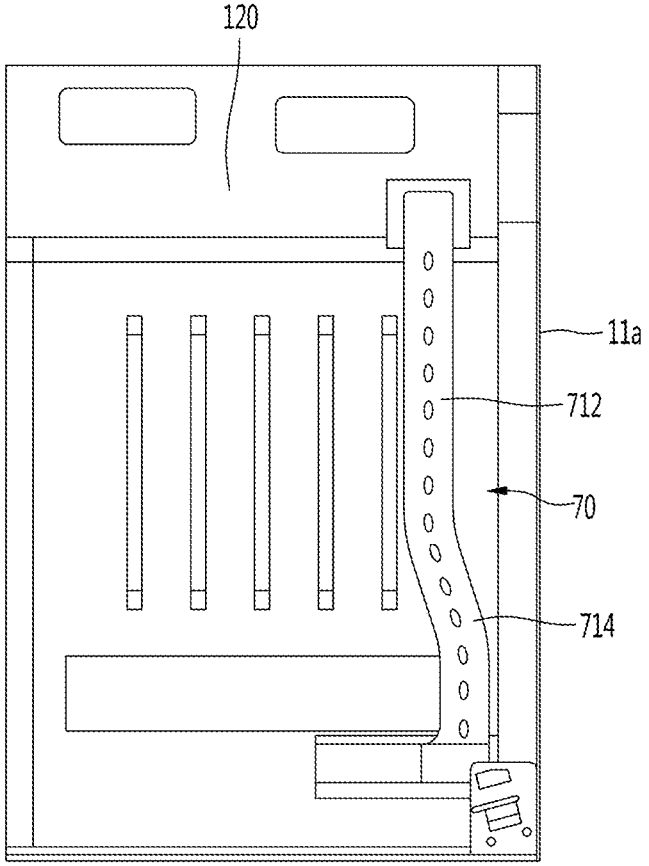
FIG. 10 is a plan view illustrating a state in which the guide duct is disposed above the inner case according to an embodiment.
Figure 11:
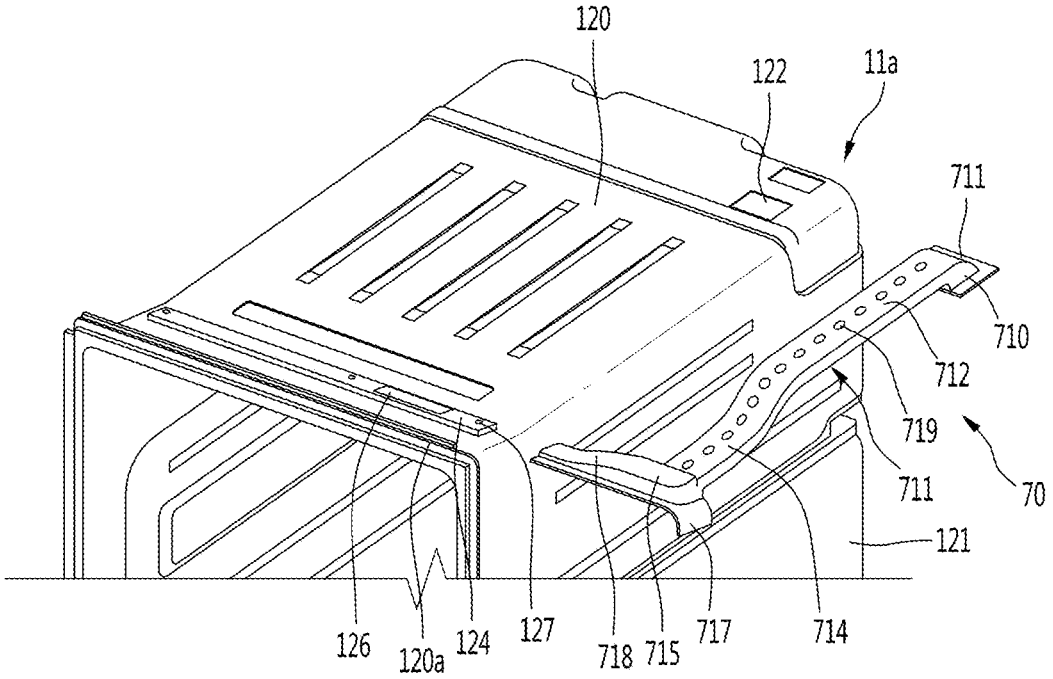
FIG. 11 is a perspective view illustrating a state in which the guide duct is separated from the inner case.
Figure 12:
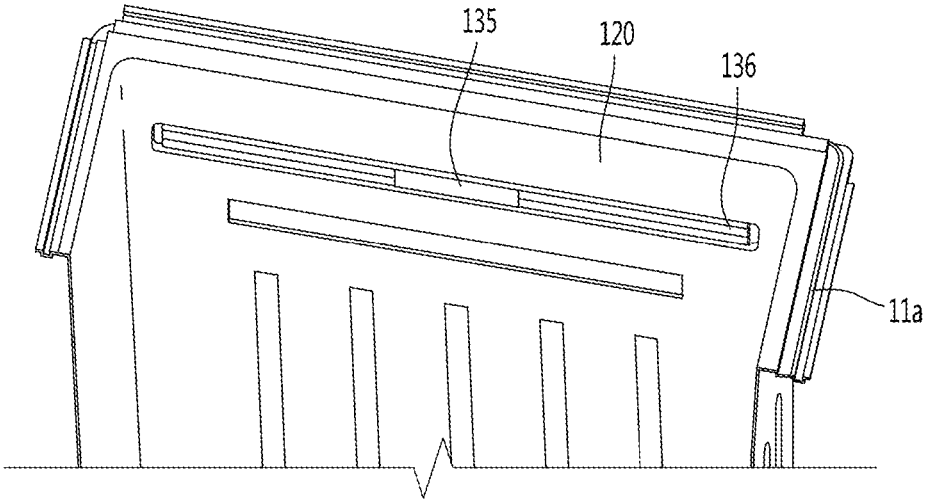
FIG. 12 is a view illustrating a state in which a discharge grill is installed on an upper wall of the inner case.

FIG. 10 is a plan view illustrating a state in which the guide duct is disposed above the inner case according to an embodiment, FIG. 11 is a perspective view illustrating a state in which the guide duct is separated from the inner case, and FIG. 12 is a view illustrating a state in which a discharge grill is installed on an upper wall of the inner case.

Figure 13:
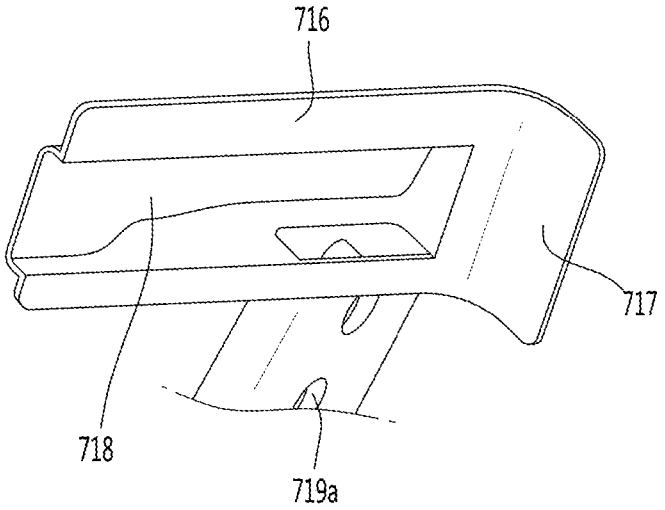
FIG. 13 is a view illustrating a cold air outlet part of the guide duct.
Figure 14:
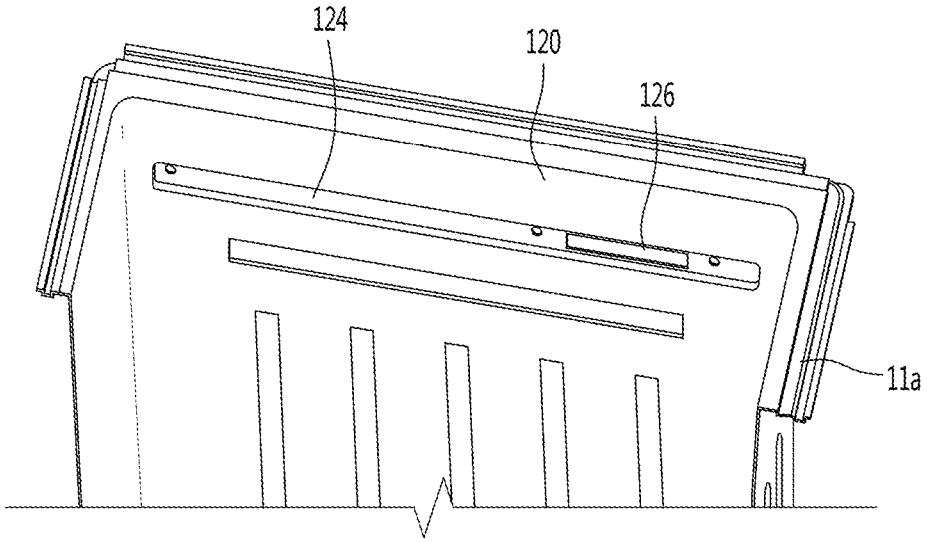
FIG. 14 is a view illustrating a state in which the discharge grill is separated from the upper wall of the inner case.
Figure 15:
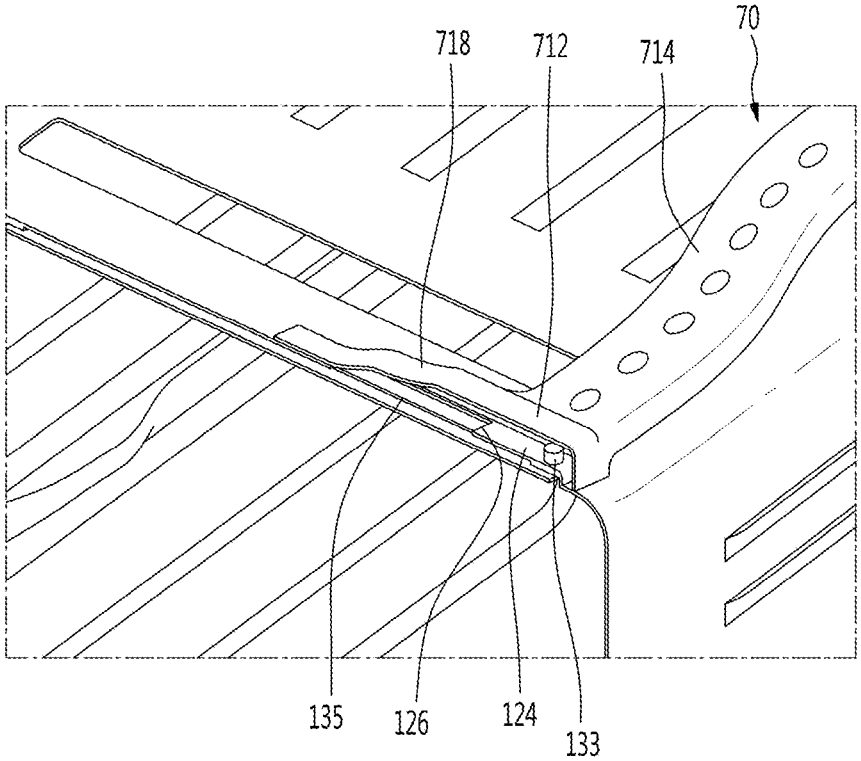
FIG. 15 is a cross-sectional view illustrating a state in which the cold air outlet part of the guide duct is seated on the upper wall of the inner case.

FIG. 13 is a view illustrating a cold air outlet part of the guide duct, and FIG. 14 is a view illustrating a state in which the discharge grill is separated from the upper wall of the inner case. FIG. 15 is a cross-sectional view illustrating a state in which the cold air outlet part of the guide duct is seated on the upper wall of the inner case.

Referring to FIGS. 10 to 15, the inner case 11*a* may further include a first opening 122 communicating with the second cold air outlet 624 and a second opening 126 spaced apart from the first opening 122 in the front and rear direction.

For example, the first opening 122 and the second opening 126 may be defined in the upper wall 120 of the inner case 11*a*.

The first opening 122 may be defined at a position that faces the second cold air outlet 625. The second opening 126 may be defined at the front of the first opening 122. For example, the second opening 126 may be defined close to a front part 120*a* of the upper wall 120 of the inner case 11*a*.

The cold air discharged from the first cold air outlet 620 of the cold air duct 60 may flow to the refrigerating compartment door 16. Here, the cold air discharged to the refrigerating compartment 112 may descend while flowing to the refrigerating compartment 16 due to characteristics of the cold air.

Thus, the cold air may not directly reach the upper portion of the refrigerating compartment door 16.

In this embodiment, the second opening 126 may be disposed to vertically overlap the refrigerating compartment door 16 in the state in which the refrigerating compartment door 16 is closed so that the cold air directly flows to the upper side of the refrigerating compartment door 16.

The guide duct 70 allows the first opening 122 to communicate with the second opening 126. That is, the guide duct 70 may allow the cold air discharged to the outside of the inner case 11*a* through the first opening 122 to be introduced into the inner case 11*a* through the second opening 126.

The cold air duct 70 may include a cold air inlet part 710 communicating with the first opening 122, a cold air outlet part 715 communicating with the second opening 126, and a path part 711 through which the cold air inlet part 710 and the cold air outlet part 715 are connected to each other.

A portion of the cold air inlet part 710 may be rounded forward so that air passing through the first opening 122 is guided forward.

The path part 711 may include a first portion 712 disposed to be spaced a first distance from the sidewall 121 of the inner case 11*a* and a second portion 714 extending to the second opening 126 in a state of being horizontally bent from the first portion 712.

The second portion 714 may be disposed to be spaced a second distance from the sidewall 121 of the inner case 11*a*. Here, the first distance may be greater than the second distance.

As described above, an insulation material may be provided between the inner case 11*a* and the outer case 11*b*. As a distance between the path part 711 and the sidewall 121 increases, deterioration in insulation performance of the guide duct 70 may be minimized.

The arrangement of the path part 711 may be changed according to a structure installed on the upper wall 120 of the inner case 11*a*. However, it is preferable to design the path part 711 so that the distance from the sidewall 121 is sufficiently secured within a range in which the path part 711 does not interfere with the structure.

When the insulation material is disposed between the inner case 11*a* and the outer case 11*b*, the insulation material may surround the cold air duct 70.

A high-temperature foaming solution may be injected between the inner case 11*a* and the outer case 11*b*. When the foaming solution is cured, the insulation material may be completed.

Here, the path part 711 may include one or more reinforcement parts 719 and 719*a* to prevent the path part 711 from being deformed by the high-temperature foaming solution.

The reinforcement parts 719 and 719*a* may be recessed parts that are formed by recessing a portion of the path part 711 inward.

For example, the reinforcement parts 719 and 719*a* may be provided in one surface or a plurality of surfaces of the path part 711.

Referring to FIGS. 11 and 13, for example, at least one reinforcement part 719 may be provided in a top surface of the path part 711, and at least one reinforcement part 719*a* may be provided in a bottom surface of the path part 711.

Alternatively, the plurality of reinforcement parts 719 and 719*a* may be provided in each of the top and bottom surfaces of the path part 711. In this case, the plurality of reinforcement parts 719 and 719*a* may be arranged to be spaced apart from each other in a longitudinal direction (for example, the front and rear direction of the refrigerator) of the path part 711.

Although not limited, when the plurality of reinforcement parts 719 and 719*a* are disposed on each of the top and bottom surfaces of the path part 711, the reinforcement part 719 disposed on the top surface may be disposed to face the reinforcement part 719*a* disposed on the bottom surface.

Each of the reinforcement parts 719 and 719*a* may be spaced apart from both surfaces of the path part 711 so that the cold air smoothly flows.

The reinforcement part 719 disposed on the top surface and the reinforcement part 719*a* disposed on the bottom surface may be spaced apart from each other in the vertical direction so that an increase of the flow resistance is minimized by the reinforcement parts 719 and 719*a*.

Although not limited, the bottom surface of the path part 711 may be spaced apart from the upper wall 120 of the inner case 11*a*. Thus, a portion of the insulation material may be disposed in a space between the bottom surface of the path part 711 and the upper wall 120 of the inner case 11*a*.

A flange 711 extending from the cold air inlet part 710 in the horizontal direction may be provided to prevent the cold air from leaking through a gap between the first opening 122 and the cold air inlet part 710. The flange 711 may contact the upper wall 120 of the inner case 11*a*.

Since the second cold air outlet 625 is disposed close to the right surface on the top surface of the frame 600, the first opening 122 may be disposed close to the side surface 121 (for example, the right surface) of the inner case 11*a*.

The second opening 126 may also be disposed close to the side surface 121 (for example, the right surface) of the inner case 11*a* to prevent the path part 711 from increasing in length.

In this embodiment, the opening 126 may have a horizontal width greater than that of the first opening 122. Also, at least a portion of the second space 126 may be disposed farther from the side surface 121 than the first opening 122.

Thus, the cold air outlet part 715 may have a horizontal width greater than that of the cold air inlet part 710 to change a flow direction of the cold air flowing forward along the path part 711 into a lateral direction.

The cold air outlet part 715 may include an inclined guide surface 718 so that the cold air flowing through the path part 711 smoothly flows to the second opening 126.

For example, the guide surface 718 may be inclined downward from the side surface 121 (to the left side) as the guide surface 718 grows away from the side surface 121.

The cold air flowing along the path part 711 may flow to a central portion of the refrigerating compartment 112 at a position that is adjacent to the sidewall 121 by the guide surface 718.

In addition, the flange 716 for preventing the cold air from leaking through the gap between the cold air outlet 715 and the second opening 126 may be disposed on the cold air outlet part 715. Here, a portion of the flange 716 may contact the upper wall 120 of the inner case 11*a*, and the other portion may contact the connection part between the upper wall 120 and the sidewall 121.

The connection part between the upper wall 120 and the sidewall 121 of the inner case 11*a* may be rounded. Thus, the other portion 717 of the flange 716 may also be rounded.

A grill installation part 124 for installing a discharge grill 135 may be further disposed on the upper wall 120 of the inner case 11*a*. The discharge grill 135 may include at least one discharge hole 136 through which the cold air passing through the second opening 126 is discharged to the refrigerating compartment 112.

Although not limited, the discharge grill 135 may include a plurality of discharge holes 136 arranged in a left and right direction. The cold air may be uniformly distributed in the left and right direction by the plurality of discharge holes 136.

For example, the grill installation part 124 may be formed by recessing a portion of the upper wall 120 of the inner case 11*a* upward. Thus, the grill installation part 124 may protrude upward from the upper wall 120 of the inner case 11*a*, and the second opening 126 may be defined in the grill installation part 124. Also, the cold air outlet part 715 may cover the second opening 126 while surrounding the grill installation part 124.

The discharge grill 135 may be coupled to the grill installation part 124 by a coupling member 133 in a state in which the discharge grill 135 is accommodated in the grill installation part 124.

According to this embodiment, the second opening 126 may be prevented from being exposed by the discharge grill 135.

Also, the grill installation part 124 may protrude upward from the upper wall 120 of the inner case 11*a*, and the discharge grill 135 may be accommodated in the grill installation part 124. Thus, the refrigerating compartment 112 may be prevented from being reduced in capacity by the discharge grill 135.

Also, since the cold air duct 70 is disposed outside the inner case 11*a*, formation of dew within the cold air duct 79 may be minimized.

Hereinafter, a flow of the cold air in the cold air duct and the guide duct will be described.

Figure 16:
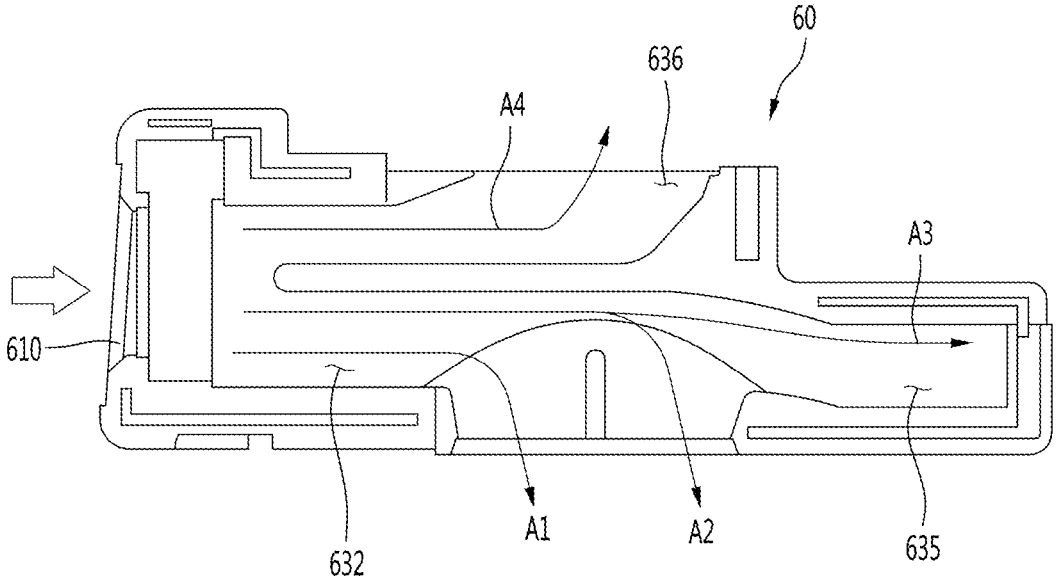
FIG. 16 is a view illustrating a flow of cold air in the cold air duct according to an embodiment.
Figure 17:
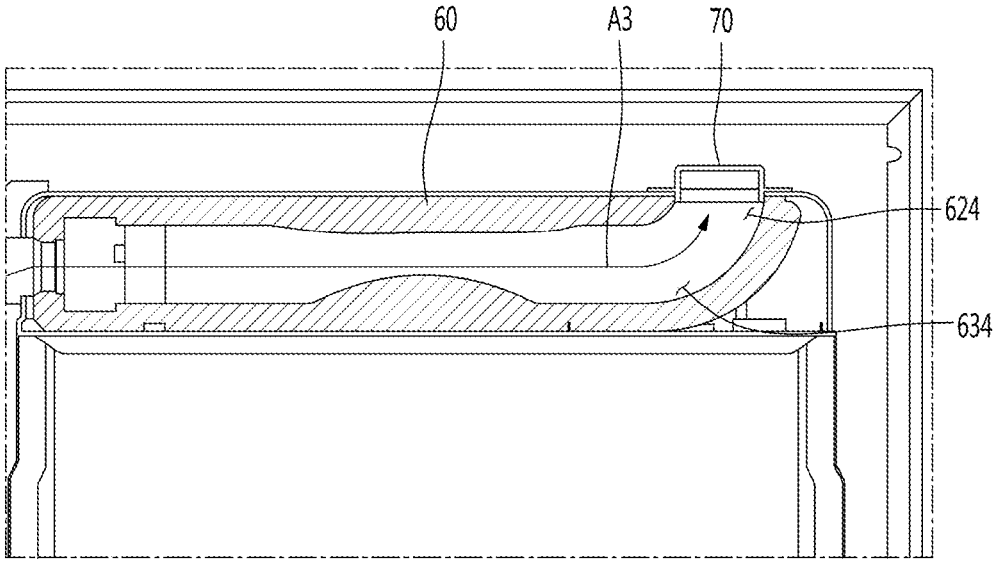
FIG. 17 is a view illustrating a flow of cold air in a second cold air passage of the cold air duct.
Figure 18:
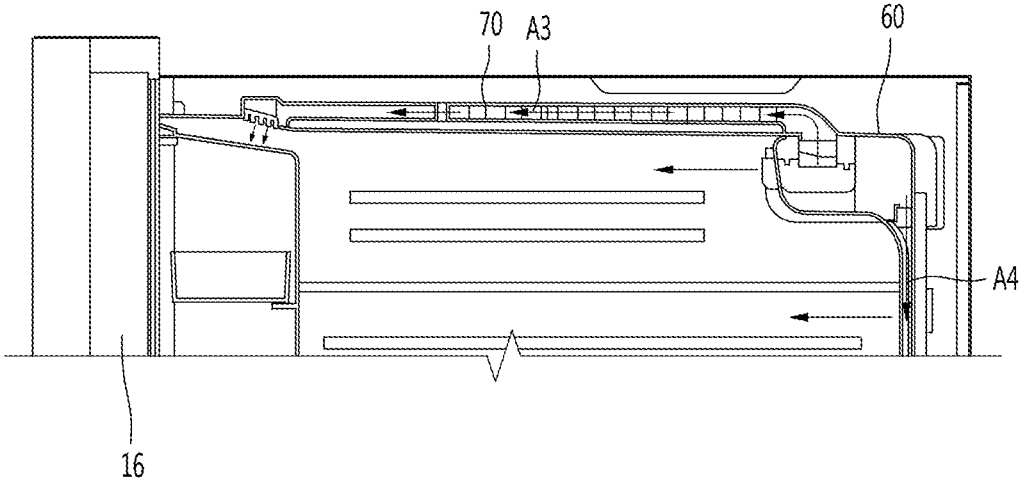
FIG. 18 is a schematic view illustrating a state in which cold air is discharged from the guide duct to a refrigerating compartment door according to an embodiment.

FIG. 16 is a view illustrating a flow of cold air in the cold air duct according to an embodiment, FIG. 17 is a view illustrating a flow of cold air in a second cold air passage of the cold air duct, and FIG. 18 is a schematic view illustrating a state in which cold air is discharged from the guide duct to a refrigerating compartment door according to an embodiment.

Referring to FIGS. 1 to 18, the cold air of the freezing compartment 111 may be introduced into the cold air duct 60 through the cold air inlet 610 of the cold air duct 60 after passing through the connection passage 114.

A portion of the cold air introduced into the cold air duct 60 may flow along the first cold air passage 632.

A portion of the cold air flowing along the first cold air passage 632 is discharged to the refrigerating compartment 112 through the first front outlet 621 (see an arrow A1).

The other portion of the cold air flowing along the first cold air passage 632 is discharged to the refrigerating compartment 112 through the second front outlet 622 (see an arrow A2).

Also, further another portion of the cold air flowing along the first cold air passage 632 flows to the second cold air outlet 624 through the second cold air passage 634 (see an arrow A3).

The cold air discharged from the cold air duct 60 through the second cold air duct 624 is introduced into the cold air inlet part 710 of the guide duct 70 after passing through the first opening 122.

Also, the cold air introduced through the cold air inlet part 710 flows forward through the path part 711 and then is discharged from the guide duct 70 through the cold air outlet part 715.

The cold air discharged from the guide duct 70 is introduced into the grill installation part 124 through the second opening 126 and supplied to the refrigerating compartment 112 through the discharge holes 136 of the discharge grill 135.

For example, at least a portion of the discharge holes 136 may be disposed to vertically overlap the refrigerating compartment door 16 so that the cold air is directly discharged to the upper side of the refrigerating compartment door 16.

Also, the other portion of the cold air introduced into the cold air duct 60 may flow along the third cold air passage 636.

The cold air flowing along the third cold air passage 636 is discharged downward from the cold air duct 60 through the third cold air outlet 625 and then discharged to the refrigerating compartment 112 by the discharge duct 90 (see an arrow A4).

According to the proposed invention, the cold air may be discharged to the upper side of the refrigerating compartment by the guide duct to minimize a temperature deviation between articles stored in the storage compartment door and articles stored in the storage compartment.

Also, since the cold air is supplied to the storage compartment and the storage compartment door by the guide duct, a temperature within the storage compartment may be uniform on the whole.

According to the proposed invention, the cold air may be discharged to the upper side of the refrigerating compartment by the guide duct to minimize a temperature deviation between articles stored in the storage compartment door and articles stored in the storage compartment.

Also, since the cold air is supplied to the storage compartment and the storage compartment door by the guide duct, a temperature within the storage compartment may be uniform on the whole.

Also, since the guide duct is disposed outside the inner case defining the storage compartment, the reduction of the capacity of the storage compartment may be prevented by the guide duct.

Also, since a portion of the cold air introduced through the cold air inlet in the cold air duct flows the second cold air passage via the first cold air passage, and the cold air of the second cold air passage flows to the second cold air passage by the rounded guide part, the cold air may smoothly flow to the guide duct that is disposed outside the storage compartment.

Also, since the path part of the cold air duct includes one or more reinforcement parts, the path part may be prevented from being deformed while the insulation material is provided between the inner case and the outer case.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet comprising an inner case that defines a storage compartment, and an outer case that surrounds the inner case;

a storage compartment door configured to open and close at least a portion of the storage compartment;

a cold air duct disposed in the storage compartment and configured to discharge cold air to the storage compartment, the cold air duct comprising (i) a frame that defines an air passage and (ii) a partition that is disposed in the frame and that divides the air passage; and a guide duct disposed between the inner case and the outer case and configured to communicate with the cold air duct, the guide duct extending toward the storage compartment door and being configured to guide cold air received from the cold air duct to the storage compartment door, wherein the inner case comprises an upper wall defining a first opening and a second opening that are configured to communicate with each other through the guide duct, wherein at least a portion of the second opening is configured to overlap with the storage compartment door based on the storage compartment door being closed, and wherein the guide duct comprises:

a cold air inlet configured to communicate with the first opening, a cold air outlet configured to communicate with the second opening, and a connection path that extends from the cold air inlet to the cold air outlet.

2. The refrigerator of claim 1, wherein the guide duct further comprises a flange that is disposed at at least one of the cold air inlet or the cold air outlet and that is in contact with the upper wall of the inner case.

3. The refrigerator of claim 2, wherein the flange is disposed at the cold air outlet and in contact with a corner between the upper wall and a sidewall of the inner case.

4. The refrigerator of claim 2, further comprising:

a grill installation part that protrudes upward from the upper wall of the inner case and that is disposed at a position corresponding to the second opening of the inner case; and a discharge grill that is coupled to the grill installation part and that defines a plurality of discharge holes.

5. The refrigerator of claim 4, wherein the plurality of discharge holes extend toward a sidewall of the inner case.

6. The refrigerator of claim 4, wherein at least a portion of the plurality of discharge holes is configured to, based on the storage compartment door being closed, be positioned vertically above the storage compartment door and face an upper side of the storage compartment door.

7. The refrigerator of claim 1, wherein the frame comprises:

a frame cold air inlet;

a first cold air outlet configured to discharge a first portion of cold air received through the frame cold air inlet to the storage compartment; and a second cold air outlet configured to discharge a second portion of the cold air received through the frame cold air inlet to the guide duct, and wherein the partition comprises a partition rib disposed between the first cold air outlet and the second cold air outlet.

8. The refrigerator of claim 7, wherein the frame comprises:

a first side surface that defines the frame cold air inlet;

a front surface that defines the first cold air outlet and that faces the storage compartment door; and a top surface that defines the second cold air outlet.

9. The refrigerator of claim 8, wherein the frame further comprises a second side surface opposite to the first side surface, and wherein the second cold air outlet is defined at a position that is closer to the second side surface of the frame than to the first side surface of the frame.

10. The refrigerator of claim 9, wherein the air passage of the frame comprises:

a first cold air passage configured to guide the cold air received through the frame cold air inlet toward the first cold air outlet; and a second cold air passage that extends from the first cold air passage and that is configured to guide a portion of the cold air received through the frame cold air inlet to the second cold air outlet, wherein the frame is configured to supply at least a portion of the cold air in the first cold air passage to the second cold air passage along a line that extends from the frame cold air inlet to the second cold air passage, and wherein the partition further comprises a passage partition part disposed between the first cold air passage and the second cold air passage.

11. The refrigerator of claim 1, wherein the connection path comprises (i) a first portion that is horizontally spaced apart from a sidewall of the inner case by a first distance and (ii) a second portion that is horizontally bent from the first portion, that extends to the second opening, and that is horizontally spaced apart from the sidewall of the inner case by a second distance that is less than the first distance.

12. A refrigerator comprising:

a cabinet comprising an inner case that defines a storage compartment, an outer case that surrounds the inner case, and an insulation material disposed between the inner case and the outer case;

a storage compartment door configured to open and close at least a portion of the storage compartment;

a cold air duct disposed in the storage compartment and configured to discharge cold air to the storage compartment, the cold air duct comprising (i) a frame that defines an air passage and (ii) a partition that is disposed in the frame and that divides the air passage; and a guide duct disposed between the inner case and the outer case and configured to communicate with the cold air duct, the guide duct extending toward the storage compartment door and being to guide cold air received from the cold air duct to the storage compartment door, wherein the inner case comprises an upper wall defining a first opening and a second opening that are configured to communicate with each other through the guide duct, wherein at least a portion of the second opening is configured to overlap with the storage compartment door based on the storage compartment door being closed, and wherein the guide duct comprises:

a cold air inlet configured to communicate with the first opening, a cold air outlet configured to communicate with the second opening, and a connection path that extends from the cold air inlet to the cold air outlet, the connection path comprising at least one reinforcement part.

13. The refrigerator of claim 12, wherein the at least one reinforcement part is a recess that is recessed from a surface of the connection path.

14. The refrigerator of claim 12, wherein the at least one reinforcement part comprises a first reinforcement part disposed at a top surface of the connection path, and a second reinforcement part disposed at a bottom surface of the connection path.

15. The refrigerator of claim 12, wherein the at least one reinforcement part comprises a plurality of first reinforcement parts disposed at a top surface of the connection path, and a plurality of second reinforcement parts disposed at a bottom surface of the connection path.

16. The refrigerator of claim 15, wherein the plurality of first reinforcement parts are arranged along a longitudinal direction of the connection path and spaced apart from one another in the longitudinal direction of the connection path, and wherein the plurality of second reinforcement parts are arranged along the longitudinal direction of the connection path and spaced apart from one another in the longitudinal direction of the connection path.

17. The refrigerator of claim 15, wherein at least one of the plurality of first reinforcement parts faces at least one of the plurality of second reinforcement parts.

18. The refrigerator of claim 15, wherein each of the plurality of first reinforcement parts is spaced apart from one of the plurality of second reinforcement parts in a vertical direction.

19. The refrigerator of claim 12, wherein a bottom surface of the connection path is spaced apart from the upper wall of the inner case, and wherein a portion of the insulation material is disposed between the upper wall of the inner case and the bottom surface of the connection path.

20. The refrigerator of claim 12, wherein the guide duct further comprises a flange that is disposed at at least one of the cold air inlet or the cold air outlet and that is in contact with the upper wall of the inner case.

21. The refrigerator of claim 20, wherein the flange is disposed at the cold air outlet and in contact with a corner between the upper wall and a sidewall of the inner case.

* * * * *